United States Patent [19]

Ishiyama

[11] 4,240,862

[45] Dec. 23, 1980

[54] PRINTING SYSTEM FOR BOARDING PASS AND/OR BAGGAGE TAG

[75] Inventor: Kiyoshige Ishiyama, Ise, Japan

[73] Assignee: Shinko Electric Co., Ltd., Tokyo, Japan

[21] Appl. No.: 922,828

[22] Filed: Jul. 10, 1978

[30] Foreign Application Priority Data

Jul. 20, 1977 [JP] Japan ..... 52-87520
Jul. 21, 1977 [JP] Japan ..... 52-88002

[51] Int. Cl.[3] ..... G07B 1/00

[52] U.S. Cl. ..... 156/350; 101/66; 101/93.05; 101/93.07; 156/351; 156/361; 156/362; 156/364; 156/384; 156/510; 156/584; 346/97

[58] Field of Search ..... 156/351, 361, 362, 364, 156/384, 584, 510, 350; 101/66, 67, 93.07, 93.05; 346/97

[56] References Cited

U.S. PATENT DOCUMENTS

| | | | |
|---|---|---|---|
| 2,741,980 | 4/1956 | Arcus | 101/93.07 |
| 2,973,707 | 3/1961 | Crivelli | 101/66 |
| 2,983,187 | 5/1961 | Bone | 101/66 |
| 2,993,436 | 7/1961 | Weingart | 101/67 |
| 3,774,530 | 11/1973 | Wouchie et al. | 101/66 |
| 4,072,224 | 2/1978 | Barnaby et al. | 101/93.05 |

*Primary Examiner*—Caleb Weston

[57] ABSTRACT

A printing system for a boarding pass and/or a baggage tag comprises an operating unit; a housing; a control unit in the housing receiving instructions from the operating unit; and two printing units in the housing controlled with the control unit. One printing unit includes: a roll of printing paper strip; a feeding mechanism for drawing out the paper strip; guide members for the strip; a dotting printer for printing characters on the strip; a cutting unit for cutting the strip after being printed; and an ejecting mechanism for ejecting the printed and cut printing paper strip as a boarding pass or a baggage tag from the housing. The other printing unit includes: a roll of a second printing paper strip, and a similar feeding mechanism, guide members, dotting printer, cutting unit, and an ejecting mechanism for ejecting the printed and cut second printing paper strip as a baggage tag from the housing. In addition, the other unit includes: a roll or an adhesive tape consisting of a tape base, and double-sided adhesive pieces and cover pieces, which are substantially equal to each other in size, and constituting adhesive members, and the adhesive members being attached at regular intervals on the tape base; a stripping member for stripping the adhesive members; a take-up mechanism for taking up the tape base from the tape roll; and an attaching mechanism. One of the adhesive members is stripped from the tape base by the stripping member, to be attached at the adhesive surface of the adhesive member to the back of the printed and cut printing strip as the baggage tage by the attaching mechanism when the tape base is intermittently taken up by the take-up mechanism.

23 Claims, 23 Drawing Figures

Fig. 2.
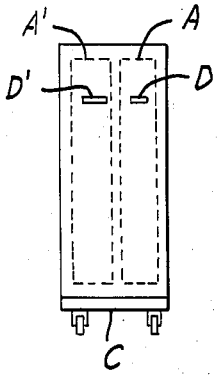
Fig. 1.
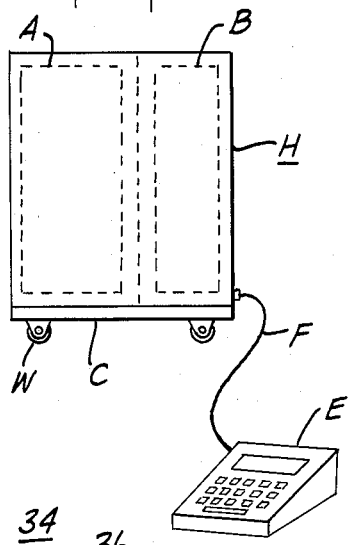
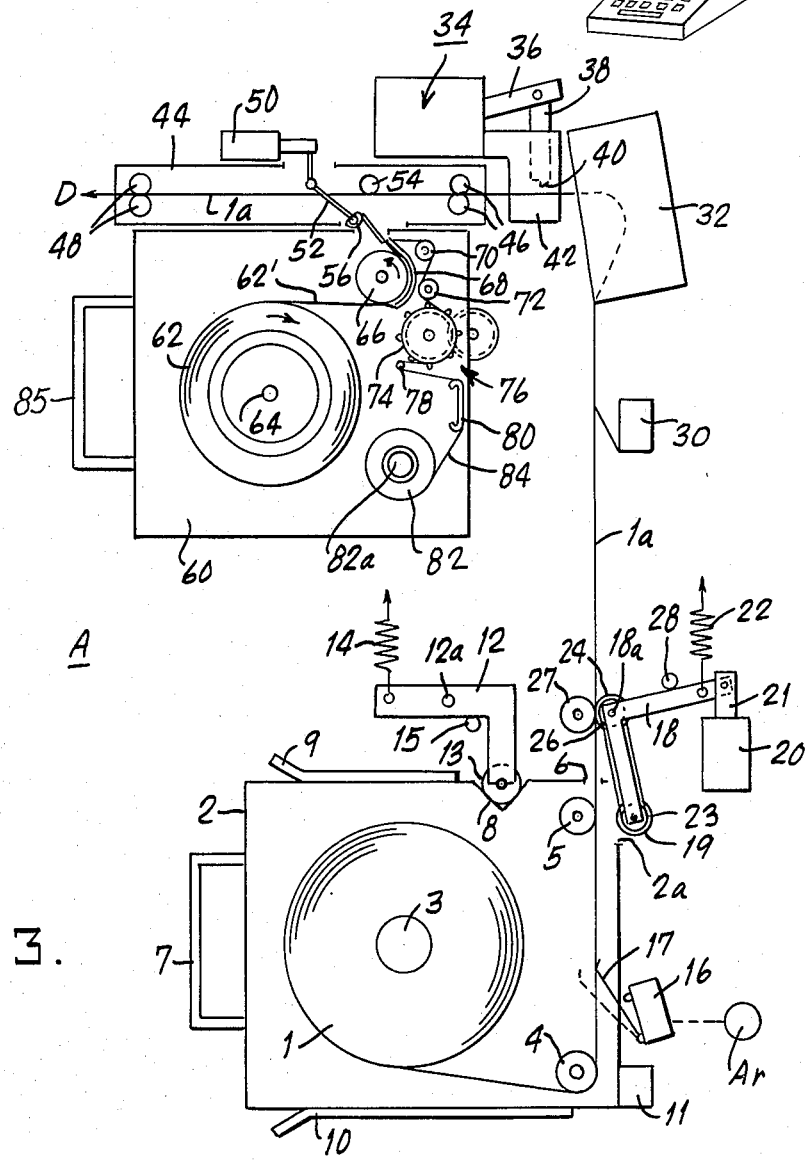
Fig. 3.

Fig. 9.
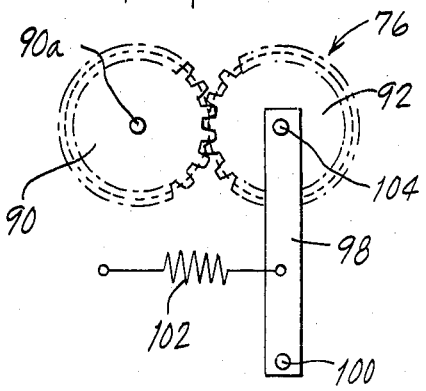
Fig. 10.
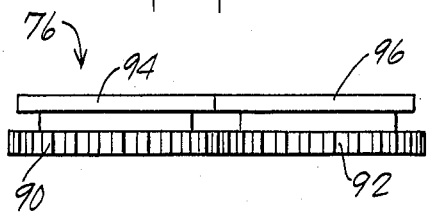
Fig. 11.
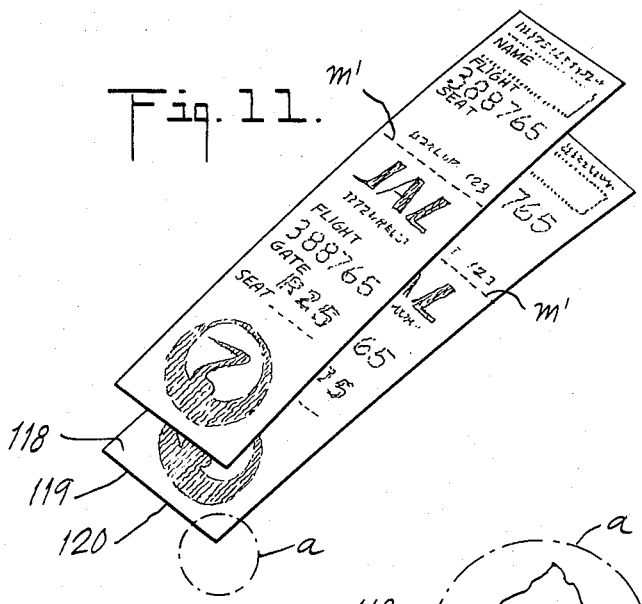
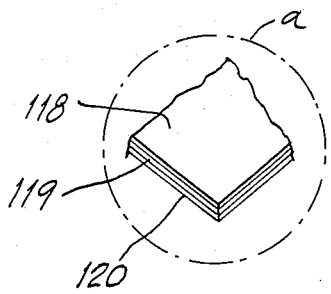
Fig. 12.

Fig. 13.
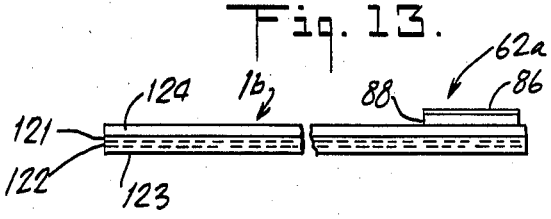
Fig. 14.
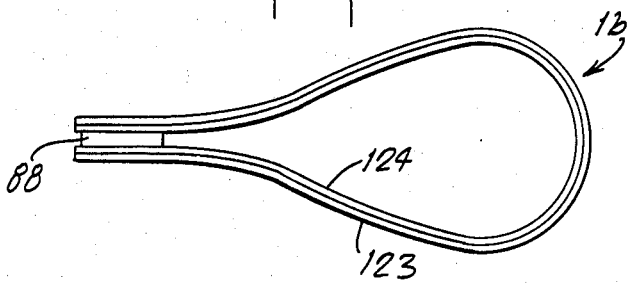
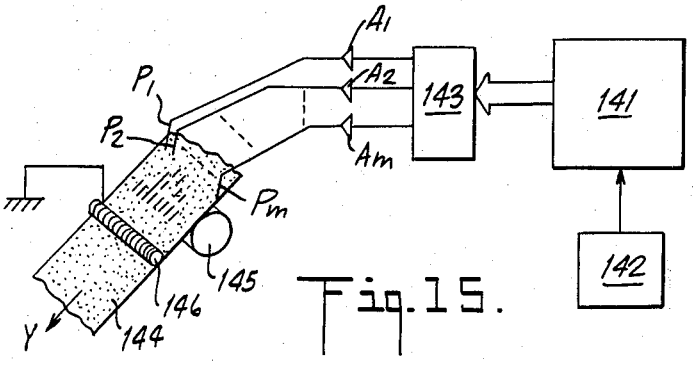
Fig. 15.
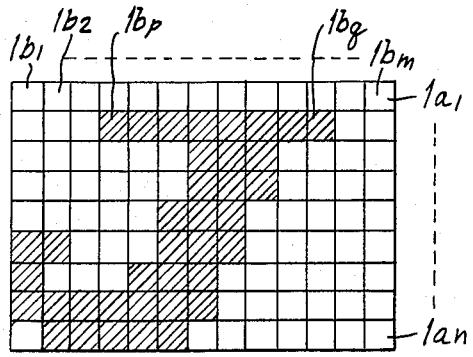
Fig. 16.

PRINTING SYSTEM FOR BOARDING PASS AND/OR BAGGAGE TAG

BACKGROUND OF THE INVENTION

1. Field of the Invention

This invention relates to a printing system for a boarding pass and/or a baggage tag, and more particularly to a printing system for a boarding pass and/or a baggage tag suitable for the check-in operation specified by airlines.

2. Description of the Prior Art

At an airline terminal a ticket clerk or check-in clerk writes required matters, such as flight number and boarding date, on a preprinted card used as a boarding pass (ticket) or baggage tag, by hand or by stamping, for each passenger in order to issue the boarding pass or baggage tag to the passenger. However, such an issuing operation requires a considerable amount of time. Accordingly, it requires many ticket clerks or check-in clerks to issue boarding passes or baggage tags to shorten waiting time for passengers. That increases personnel expenditure. Further, the letters or numerals written by hand are often hard to decipher. Many kinds of preprinted cards must be prepared for lessening the number of characters to be written. However, it is difficult to foresee the coefficients of utilization of the different kinds of preprinted cards so that some kinds may be idly stocked for a long time. That is not economical.

When all of the characters are printed on a card or paper by stamping, many kinds of stamps must be prepared. An automatic printer including many kinds of stamps is complicated in construction, and large-sized.

SUMMARY OF THE INVENTION

Accordingly, it is an object of this invention to provide a printing system for printing boarding passes and/or baggage tags which overcomes the above-described disadvantages of the conventional check-in operation, and can efficiently issue boarding passes and baggage tags for passengers.

Another object of this invention is to provide a printing system for a boarding pass and/or baggage tag which is compact in construction.

A further object of this invention is to provide a printing system for a boarding pass and/or a baggage tag which is easily handled.

A still further object of this invention is to provide a printing system for a boarding pass and/or a baggage tag in which the issue efficiency is very high.

A still further object of this invention is to provide a printing system for a boarding pass and/or a baggage tag in which the issued boarding pass and/or a baggage tag is resistant to tearing.

A still further object of this invention is to provide a printing system for a boarding pass and/or a baggage tag by which various conventional troubles in passenger's gate check-in are lessened.

A still further object of this invention is to provide a printing system for a boarding pass and/or a baggage tag by which a boarding pass and a baggage tag can be rapidly issued for the present passenger.

A still further object of this invention is to provide a printing system for a boarding pass and/or a baggage tag which is very reliable.

In accordance with one aspect of this invention, a printing system for a boarding pass and/or a baggage tag comprises: an operating unit; a housing; a control unit in the housing receiving instructions from the operating unit; and a printing unit in the housing controlled with the control unit. The printing unit includes: a roll of printing paper strip; a feeding means for drawing out the paper strip; a guide means for the paper strip; a dotting printer for printing characters on the paper strip; a cutting means for cutting the strip after it is printed; and an ejection means for ejecting the printed and cut paper strip as a boarding pass or a baggage tag from the housing.

The above and other objects, features and advantages of this invention, will be apparent in the following detailed description of an illustrative embodiment which is to be read in connection with the accompanying drawings.

BRIEF DESCRIPTION OF THE DRAWINGS

FIG. 1 is a front view of the whole of a printing system for a boarding pass and a baggage tag, according to one embodiment if this invention;

FIG. 2 is a side view of the printing system of FIG. 1;

FIG. 3 is a schematic front view of a printing unit in the printing system of FIG. 1;

FIG. 9 is a front view of a drive mechanism employed for a part of the printing unit of FIG. 3;

FIG. 10 is a side view of the drive mechanism of FIG. 9;

FIG. 11 is a perspective view of boarding passes issued by the other printing unit of the printing system shown in FIG. 6;

FIG. 12 is an enlarged perspective view of a part of the boarding pass of FIG. 11 for explaining the structure of the boarding pass;

FIG. 13 is a side view of a baggage tag issued by the printing unit of FIG. 3;

FIG. 14 is a view for explaining the use of the baggage tag of FIG. 13;

FIG. 15 is a schematic view of an electric discharge printing apparatus applicable to the printing system;

FIG. 16 is a plan view of a part of a pattern generator in the apparatus of FIG. 15;

DESCRIPTION OF THE PREFERRED EMBODIMENTS

A check-in printing system for airlines according to one embodiment of this invention will be described with reference to the drawings.

FIG. 1 is a front view of an outline of the check-in printing system, and FIG. 2 is a side view of the outline thereof. A housing H for the check-in printing system contains a printing unit A for printing out a baggage tag, another printing unit A' for printing out a boarding pass, and a control unit B. The housing H is mounted on a truck C to which four wheels w (castor type) are attached. Slots D and D' for issuing the baggage tag and boarding pass therefrom respectively are formed on one side wall of the housing H. The control unit B in the housing H is electrically connected through an electric cable F to an operating unit E provided with a key board and display.

In the above-described system, the printing units A and A' are alternately or simultaneously operated through the control unit B by the operating unit E, to issue the baggage tag and boarding pass from the slots D and D' respectively.

Next, details of the printing units A and A' will be described with reference to FIG. 3 to FIG. 9.

Figure 7:
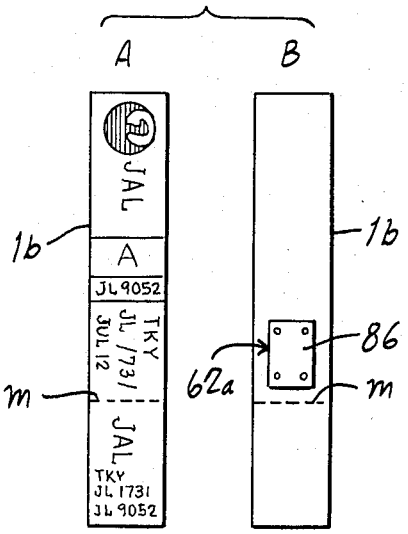
FIG. 7A is a front view of a baggage tag issued by the printing unit of FIG. 3.
FIG. 7B is a back view of a baggage tag of FIG. 7A.
Figure 8:
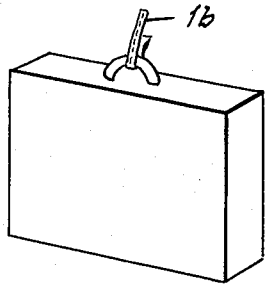
FIG. 8 is a perspective view of a bag tagged with the baggage tag of FIG. 7A and FIG. 7B in which a stub is cut off from the baggage tag.

FIG. 3 is schematic front view of the printing unit A for printing out a baggage tag of the type shown in FIG. 7. In FIG. 3, a roll 1 of a printing paper strip is fitted to a support shaft 3 which is rotatably supported on the center of a cassette or cartridge casing 2. A printing paper strip 1*a* unwound from the roll 1 is guided by a pair of guide rollers 4 and 5, which are rotatably supported in the cassette casing 2, and is led out from the cassette casing 1 through an outlet 6 formed on the upper wall of the cassette casing 2. A grip 7 is fixed on the side wall of the cassette casing 2 so that it can be easily mounted on, or demounted from, the system by hand. Further, a V-shaped recess 8 for positioning the casing 2 is formed in its upper wall. A cover (not shown) is demountably arranged on the casing 2. When a new roll 1 of the printing paper strip is supplied to the casing 2, the not-shown cover is opened, and then closed after the insertion of the new roll 1. The cover is omitted from FIG. 3 for facilitation of illustration.

A pair of guide rails 9 and 10, the top ends of which are bent upwardly and downwardly, are fixed on a chassis (not shown) mounted in the housing H. A stopper 11 is also fixed on the not-shown chassis. When the cassette casing 2 is assembled into the system, it is guided by the guide rails 9 and 10, and stopped by the stopper 11. Further, adjacent the V-shaped recess 8 of the casing 2, an L-shaped lever 12 is rotatably supported by a pin 12*a* on the not-shown chassis. A roller 13 is rotatably supported on one end of the lever 12. A spring 14 is fixed on another end of the lever 12 so as to urge the lever 12 in the clockwise direction around the pin 12*a*, and to press the roller 13 into the recess 8. The clockwise rotation of the L-shaped lever 12 is restricted by a stopper pin 15 fixed on the not-shown chassis. The casing 2 is accurately positioned by the roller 13 in the housing H of the system. A microswitch 16 for detecting the exhaustion of the printing paper strip 1*a* is arranged adjacent the casing 2. An actuating lever 17 of the microswitch 16 is pressed by the tensioned printing paper strip 1*a* between the rollers 4 and 5, when the printing paper strip 1*a* is stocked in the casing 2. The microswitch 16 is opened. When the printing paper strip 1*a* is exhausted from the roll 1, it is slackened between the guide rollers 4 and 5, and the actuating lever 17 is rotated to the position shown by the dash line by a spring contained in the microswitch 16 whereupon the microswitch 16 is closed. An exhaustion-detecting signal is supplied to an alarm Ar. The alarm Ar may be a lamp or buzzer.

An L-shaped lever 18 is rotatably supported by a support pin 18*a* at the corner near the outlet 6 of the casing 2. A roller 19 is rotatably supported on one end of the lever 18. A rod 21 of a plunger-solenoid 20 is pivoted to another end of the lever 18. Another roller 26 is rotatably supported on the corner of the lever 18. A belt 25 is wound on pulleys 23 and 24 fixed integrally with the rollers 19 and 26. A spring 22 is fixed on the other end portion of the lever 18 so as to urge the lever 18 in the counterclockwise direction around the support pin 18*a*. The roller 26 is driven with an electric motor (not shown). The counterclockwise rotation of the lever 18 is restricted by a stopper pin 28. The roller 19 faces an opening 2*a* formed in the side wall of the casing 2. When the plunger-solenoid 20 is energized, the lever 18 is rotated in the clockwise direction around the support pin 18*a*, to press the roller 19 to the guide roller 5 arranged within the casing 2. The printing paper strip 1*a* led out from the outlet 6 is pinched between a roller 27 and the facing roller 26 supported on the L-shaped lever 18, to be further transported upwardly.

The exit of the printing paper strip 1*a* from the casing 2 is sensed by another microswitch 30. The printing paper strip 1*a* is fed to a printer 32. Required matters such as the name of the airline (e.g., JAL), air route (A), flight number (JL9052) and destination (TKY) are printed on the printing paper strip 1*a* by the printer 32, in the manner shown in FIG. 7. An ink printing method, thermal printing method or electric discharge printing method may be employed for the printer 32. After the required matters are printed on the printing paper strip 1*a*, it is led to a cutting unit 34 by a feeding mechanism which is contained in the printer 32. A drive arm 36 is projected from the cutting unit 34. A cutter support 38 is attached to the drive arm 36. A sawtoothed cutter 40 is fixed on the end of the cutter support 38. With the actuation of the cutting unit 34, to which information is supplied from the control unit B, the cutter 40 is moved down to a first operative position to perforate the printing paper strip 1*a* on a table 42, as shown by m in FIG. 7. The table 42 includes a slot (not shown) into which the cutter 40 is guided. After perforating the printing paper strip 1*a*, the cutter 40 is moved up to its original position. The printing paper strip 1*a* is advanced by a predetermined length. Then, the cutter 40 is moved down to a second operative position which is lower than the first operative position, to cut the printing paper strip 1*a*. Again the cutter 40 is moved up to its original position, and the cut printing paper strip 1*a* is transported by pairs of rollers 46 and 48 which are rotatably supported by a support 44. The pairs of rollers 46 and 48 are driven with a not-shown electric motor. The cut printing paper strip 1*a* as a baggage tag on which the required matters are printed, is ejected from the slot D of the housing H of the system. While the printing paper strip 1*a* is transported by the pairs of the rollers 46 and 48, an adhesive member 62*a* consisting of a double-side adhesive piece 88 and a cover piece 86 is attached to the back of the printing paper strip 1*a*, from another cassette casing 60.

Figure 4A:
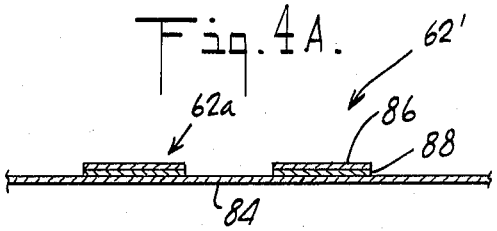
FIG. 4A is a sectional view of a part of an adhesive tape used in the printing unit of FIG. 3.
Figure 4B:
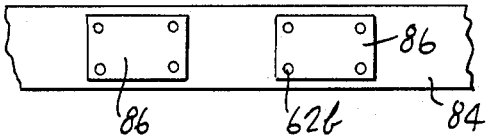
FIG. 4B is a plan view of the part of the adhesive tape of FIG. 4A.

In the cassette casing 60, a roll 62 of an adhesive tape 62' is fitted to a support shaft 64. As shown in FIG. 4A and FIG. 4B, the adhesive tape 62' comprises a series of adhesive members 62*a*, each consisting of a double-sided adhesive piece 88 and a cover piece 86, and an adhesive tape base 84 on which the adhesive members 62*a* are attached at regular intervals. Perforations 62*b* are made at regular intervals in both side portions of the adhesive tape 62', as shown in FIG. 4B, to be engaged with a sprocket wheel 74 which is arranged in the cassette casing 60, as described hereinafter. The adhesive tape 62' from the roll 62 is guided through a curved gap between a main roller 66 and a curved stripping plate 68, by the main roller 66 rotating in the counterclockwise direction shown by the arrow. As clearly shown in FIG. 5A, the adhesive tape 62' is steeply bent by the edge of the curved stripping plate 68, and as a result, the adhesive member 62*a* is stripped from the adhesive tape base 84. The adhesive member 62*a* consisting of the cover piece 86 and the double-sided adhesive piece 88 is directed to the back side of the printing paper strip 1*a*. The sprocket wheel 74 is driven with a gear mechanism 76 which is hereinafter described in detail. The adhesive tape base 84 is guided by guide rollers 70 and 72, and is engaged at the performations 62*b* by the sprocket wheel 74. Further, the adhesive tape base 84 is guided by a guide roller 78 and a guide member 80, and is taken up by a take-up reel 82 supported by a drive shaft 82*a* which is driven through a not-shown frictional drive mechanism by the gear mechanism 76.

A grip 85 is fixed on one side wall of the casing 60. The casing 60 can be easily set into and demounted from, the housing H of the system. Although not shown, parts corresponding to the guide rails 9 and 10, the stopper 11 and the lever 12 supporting the roller 13 for the casing 2 may be provided for the casing 60, in the same manner as already described for casing 2, in order to position the casing 60 in the housing H with accuracy. Further, an element corresponding to the microswitch 16 may be arranged for the casing 60, for detecting the exhaustion of the adhesive tape 62'.

Figure 5A:
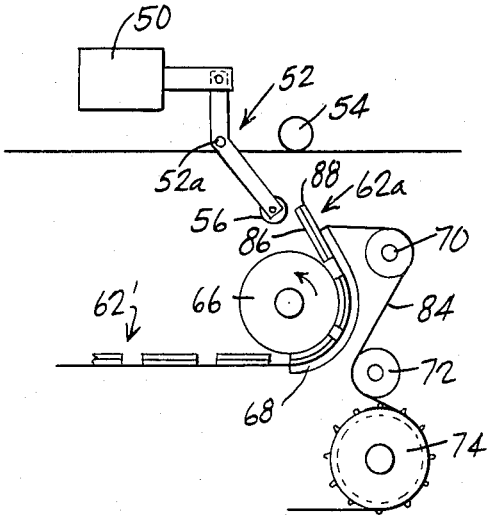
FIG. 5A and FIG. 5B are enlarged front views of a part of the printing unit of FIG. 3 illustrating its operation.
Figure 5B:
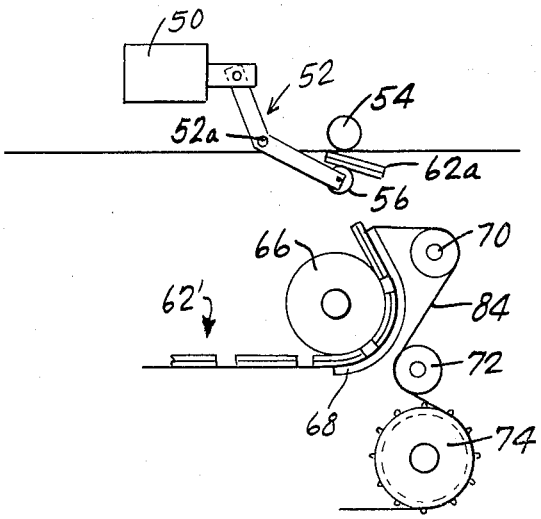

A plunger-solenoid 50 for attaching the adhesive member 62*a* to the back side of the printing paper strip 1*a* is arranged between the pairs of rollers 46 and 48. A V-shaped lever 52 is pivoted at one end to the rod of the plunger-solenoid 50, and is rotatably supported by a support pin 52*a*. A press roller 56 is rotatably supported on the other end of the V-shaped lever 52. A cooperating roller 54 is supported by the support 44 at the upper side of the printing paper strip 1*a*. When the plunger-solenoid 50 is energized, the separated adhesive member 62*a* is led between the rollers 56 and 54 as shown in FIG. 5B.

Next, details of the above-described gear mechanism 76 for driving the sprocket wheel 74 will be described with reference to FIG. 9 and FIG. 10.

In FIGS. 9 and 10, a drive gear 92 is so interlocked as to synchronize with a drive motor for driving the rollers 46 and 48 to feed the printing paper strip 1*a*. The interlocking mechanism is not shown in FIG. 9 and FIG. 10. The drive gear 92 is rotatably supported on a pin 104 which is fixed at one end of a pressing lever 98. The pressing lever 98 is rotatably supported at another end by a support pin 100, and is urged in the counterclockwise direction around the support pin 100 by a spring 102 fixed to the central portion of the pressing lever 98. A disc 96 is fixed concentrically with the drive gear 92. The diameter of the disc 96 is equal to the pitch diameter of the drive gear 92.

A cassette-side idle gear 90 is engaged with the drive gear 92. A support shaft 90*a* of the idle gear 90 is fixed concentrically with the support shaft 74*a* of the sprocket wheel 74. A disc 94 is fixed concentrically with the idle gear 90. The diameter of the disc 94 is equal to the pitch diameter of the idle gear 90. Since the disc 96 is pressed to the other disc 94 by the spring action of the spring 102, the drive gear 92 is engaged with idle gear 90 in the manner that a desirable backlash is maintained between the teeth of the drive gear 92 and idle gear 90. The distance between the centers of the gears 90 and 92 is maintained constant by the engagement of the discs 94 and 96. If the discs 94 and 96 were not so arranged, the drive gear 92 would be too deeply engaged with the idle gear 90, so that the desirable backlash could not be obtained, and the idle gear 90 could not be smoothly driven with the drive gear 92.

Further, if a frictional roller drive mechanism were employed for the drive of the sprocket wheel 74, instead of the above gear mechanism 76, some slippage would occur between the rollers, and so the adhesive member 62*a* could not be supplied to the printing paper strip 1*a* with accuracy, since a considerable torque is required for the wind-up of the adhesive tape 62' in the limited space. However, according to this embodiment, the adhesive tape 62' can be accurately wound up with the gear drive mechanism shown in FIG. 9 and FIG. 10.

Although not shown, the drive for the take-up reel 82 is a frictional drive mechanism which includes a roller fixed integrally with the gear 90 and another roller fixed integrally with the drive shaft 82*a* of the take-up reel 82. Some slippage may be permitted to occur between the rollers, since the adhesive tape 62' is already being fed by the sprocket wheel 74 with accuracy. With the issue of the baggage tags, the sprocket wheel 74 and the take-up reel 82 are intermittently driven.

Next, operations of the above described printing unit A will be described with reference to FIG. 1 to FIG. 5, FIG. 7 and FIG. 8 in more detail.

The cassette casing 2 is set into the not-shown chassis at the predetermined position in the printing unit A of the system and in such a condition that the top end of the printing paper strip 1*a* is slightly projected from the outlet 6 of the casing 2. In the setting operation, the cassette casing 2 is guided and positioned by the guide rails 9 and 10, the stopper 11 and the roller 13. In a similar manner, the cassette casing 60 containing the adhesive tape 62' is set at the predetermined position in the printing unit A of the system. In the cassette casing 60, the end of the adhesive tape 62' is threaded through the roller 66, the stripping plate 68, the guide rollers 70, 72, the sprocket wheel 74, the guide roller 78, and the guide member 80, from the roll 62 to the take-up reel 82, in the manner shown in FIG. 3.

The push-buttons of the operating unit E (FIG. 1) are selectively pushed for printing out the baggage tag required for the present passenger. The information from the operating unit E is transmitted through the control unit B to the printing unit A.

The plunger-solenoid 20 is energized, and the roller 26 is driven in the clockwise direction by the not-shown electric motor. With the energization of the plunger-solenoid 20, the roller 19 which is driven in the clockwise direction through the belt 25, is introduced through the opening 2*a* into the casing 2, and presses the printing paper strip 1*a* onto the roller 5 in the casing 2.

The printing paper strip 1*a*, which is considerably hard, is upwardly conveyed thereby to the paired rollers 26 and 27, and pinched between them. The printing paper strip 1*a* is upwardly conveyed further to the printer 32 by the paired rollers 26 and 27. The supply of the printing paper strip 1*a* to the printer 32 is detected by the sensing microswitch 30 which produces a stop signal. As a result of the stop signal, the plunger-solenoid 20 is deenergized, returning the L-shaped lever 18 to its original position as shown in FiG. 3 and rotation of the rollers 19 and 26 is stopped.

The required matters are printed on the printing paper strip 1*a* in the printer 32 which includes a feeding mechanism. Then, a predetermined length of the printing paper strip 1*a* is fed from the printer 32 to the cutting unit 34. The information required for the predetermined length is memorized in the control unit B, and supplied to the feeding mechanism of the printer 32. The cutter 40 is moved to the first operative position to perforate the printing paper strip 1*a* in the manner shown by m in FIG. 7. After the cutter 40 is moved up to the original position, the printing paper strip 1*a* is further advanced by another predetermined length. Also the information required for the other predetermined length is memorized in the control unit B. Then, the cutter 40 is moved down to the second operative position which is lower than the first operative position, to cut the printing paper strip 1*a*. Thus, the baggage tag 1*b* shown in FIG. 7 is obtained except for the application of the adhesive member 62*a* to the back thereof.

The baggage tag 1*b* is conveyed to the slot D of the housing H by the rollers 46 and 48 which are now driven by the not-shown electric motor. The length of the baggage tag 1*b* is larger than the distance between the rollers 46 and 48. For facilitation of illustration, the relative scales of the respective parts in FiG. 3 is different from the actual relationship. The length of the baggage tag 1*b* is normally 200 to 300 mm, which depends on the airline route for the present passenger.

While the printing paper strip 1*a*, or the baggage tag 1*b*, is conveyed between the rollers 46 and 48, the adhesive member 62*a* consisting of the double-sided adhesive piece 88 and cover piece 86 is attached to the back of the baggage tag 1*b*. Synchronizing with the rollers 46 and 48, the sprocket wheel 74 and therefore the take-up reel 82 are driven with the above-described gear mechanism 76. The roll 62 and the main roller 66 are rotated in the direction shown by the arrows in FIG. 3. The adhesive tape 62' is steeply bent by the upper edge of the stripping plate 68. As a result, one adhesive member 62*a* consisting of the cover piece 86 and the double-sided adhesive piece 88 is stripped from the adhesive tape base 84, and is directed between the rollers 54 and 56, as clearly shown in FIG. 5A.

Simultaneously with the take-up action of the adhesive tape 62', the plunger-solenoid 50 is energized with the information signal from the control unit B. The V-shaped lever 52 is rotated in the counterclockwise direction around the support pin 52*a*. The adhesive member 62*a* stripped from the adhesive tape base 84 is carried to the back of the baggage tag 1*b* by the roller 56 supported on the end of the V-shaped lever 52. The baggage tab 1*b* and the adhesive member are pinched between the rollers 54 and 56 as clearly shown in FIG. 5B. The adhesive member 62*a* is applied to the back of the baggage tag 1*b*. With the transport of the baggage tab 1*b* to the slot D of the housing H, the adhesive member 62*a* is attached to the back of the baggage tag 1*b* by the exposed adhesive surface of the double-sided adhesive piece 88. Thus, the baggage tag 1*b* provided with the adhesive member 62*a* is obtained as shown in FIG. 7B, and it is ejected from the slot D of the housing H of the system.

The baggage tag 1*b* is broken at the perforation m and the lower part (FIG. 7A and FIG. 7B) is given as a stub to the present passenger. The cover piece 86 may be stripped from the double-sided adhesive piece 88 and the baggage tab 1*b* so folded that a part of the back of the baggage tab 1*b* is attached to the now-exposed adhesive surface of the double-sided adhesive piece 88. Thus, the baggage tag 1*b* is fitted to the grip of the baggage (trunk) of the passenger in the manner shown in FIG. 8.

In FIG. 3, the printing paper strip 1*a* continuously extends from the roll 1 to the slot D through the printer 32, cutting unit 34 and the feed rollers 46 and 48. However, the printing paper strip 1*a* is actually separated into two pieces at the cutter 40 of the cutting unit 34. The printed and cut printing paper strip as the baggage tag 1*b* is fed out to the slot D by the feed rollers 46 and 48. The top of the printing paper strip 1*a* extending from the roll 1 stops directly before the cutter 40, until the next printing information is supplied to the printer 32. When the cassette casing 2 is newly mounted into the housing H, any matter may be initially printed on the new printing paper strip 1*a* by way of trial. In such as case, the microswitch 30 for detecting the exit of the printing paper strip 1*a* from the cassette casing 2 can be omitted from the printing unit A, since the exit of the printing paper strip 1*a* from the cassette casing 2 can be visually detected at the slot D.

Figure 6:
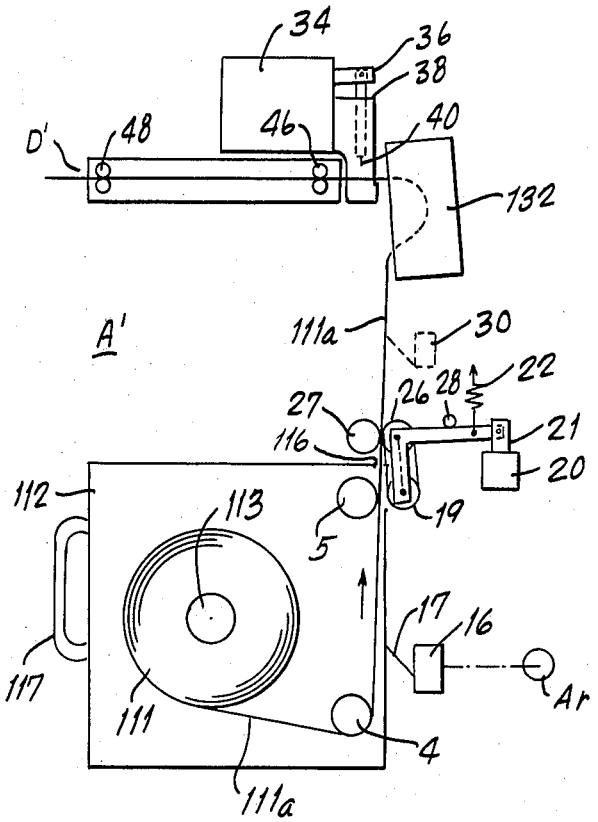
FIG. 6 is a schematic front view of another printing unit in the printing system.

FIG. 6 shows a schematic view of the printing unit A' for printing out the boarding pass. An example of the boarding pass is shown in FIG. 11. Parts in FIG. 6 which correspond to the parts in FIG. 3, are denoted by the same reference numerals, and will not be described in detail. The cassette 60 containing the adhesive tape 62' and the associated parts such as the plunger-solenoid 50 and the rollers 54 and 56, of FIG. 3 are not required for the printing unit A' of FIG. 6. The width of a printing paper strip 111*a* for the boarding pass is larger than that of the printing paper strip 1*a* for the baggage tag.

A cassette casing 112 containing a roll 111 of the printing paper strip 111*a* is set into the housing H of the system in a similar manner to the cassette casing 2 of FIG. 3. The roll 111 is fitted to a support shaft 113 in the cassette casing 112. A grip 117 is fixed to one side wall of the cassette casing 112. A cover for the cassette casing 112 is not shown in FIG. 6 for facilitation of illustration.

In operation, information from the operating unit E is changed over through the control unit B into the printing unit A'. In a similar manner to the operation of the printing unit A of FIG. 3, the printing paper strip 111*a* is taken out through an outlet 116 from the cassette casing 112, and it is supplied to a printer 132 which contains a feeding mechanism. The ink printing method, the thermal printing method or the electric discharge printing method may be employed for the printer 132. Matters required for the present passenger, such as airline No., boarding date and seat No., are printed on the printing paper strip 111*a* in the printer 132, as shown in FIG. 11. After the printing, the printing paper strip 111*a* is fed out to the cutting unit 34 by a predetermined length from the printer 132. Then, the cutter 40 is moved down to the first operative position to perforate the printing paper strip 111*a* as shown by m' in FIG. 11. The cutter 40 is moved up to the original position. The printing paper strip 111*a* is advanced by another predetermined length. The cutter 40 is moved down to the second operative position to cut the printing paper strip 111*a*. Thus, the boarding pass shown in FIG. 11 is obtained, and it is transported to the slot D' of the housing H of the system by the rollers 46 and 48. The length of the boarding pass is greater than the distance between the rollers 46 and 48. The former may be smaller than the latter. In such a case, a suitable guide member for the boarding pass may be arranged between the rollers 46 and 48, as occasion demands. The boarding pass is ejected from the slot D' of the housing H of the system.

In the above-described manners baggage tags and boarding passes for present passengers are printed out from the printing system of FIG. 1 and FIG. 2. When the printing paper strip 1*a* or 111*a* has been exhausted in the cassette casing 2 or 112, the microswitch 16 detects the exhaustion, and the alarm Ar informs the operator of it. The operator can easily and rapidly set a cassette casing 2 or 112 containing the new roll into the housing H of the system, after demounting the old cassette casing 2 or 112.

A microswitch for detecting the exhaustion of the adhesive tape 62' may be arranged adjacent the cassette casing 60 in a similar manner to the microswitch 16. An alarm is connected to the microswitch to inform the operator of the exhaustion of the adhesive tape 62'.

Since the printing units A and A' are controlled with the common control unit B and operating unit E, the printing system according to this embodiment can be very compact.

Next, structure of the printing paper strip 111*a* for the boarding pass will be described with reference to FIG. 11 and FIG. 12. When the electric discharge printing method is employed for the printer 132 of the printing unit A', the printing paper strip 111*a* of the structure shown in FIG. 12 can be used with convenience, in this embodiment of the invention.

FIG. 12 shows an enlarged perspective view of a part of the printing paper strip 111*a* according to this embodiment. The part is indicated by a dot-dash circle which is denoted by a. A flexible film 119 is interposed between a printing paper sheet 118 and a lining paper sheet 120. Aluminum is vapor-deposited on the printing paper sheet 118 in the normal manner. The flexible film 119 is made of, for example, synthetic resin. The lining paper sheet 120 is made of a similar material to that of a conventional electric discharge printing paper which consists only of the printing paper sheet with aluminum layer and the lining paper sheet.

The conventional electric discharge printing paper is apt to chemically change in nature with the electric discharge printing, and as a result, it is liable to be torn. However, since the flexible film 119 is interposed between the printing paper sheet 118 and the lining paper sheet 120, the printing paper strip 111*a* resists tearing, even after the electric discharge printing. It is very flexible. The passenger can roughly handle the boarding pass. That is very convenient.

Next, the structure of the printing paper strip 1*a* for the baggage tab 1*b* will be described with reference to FIG. 13 and FIG. 14. When the adhesive member 62*a* is attached to the back of the baggage tag, the printing paper strip 1*a* of the structure shown in FIG. 13 can be used with convenience, in this embodiment of the invention. Parts in FIG. 13 which correspond to those in FIG. 4A and FIG. 4B are denoted by the same reference numerals.

In FIG. 13, an aluminum layer 123 is deposited on a printing paper sheet 122. A lining paper sheet 121 is attached to the back of the printing paper sheet 122. The printing paper sheet 122 is further matted with a resinous layer 124 according to this embodiment. The adhesive member 62*a* consisting of the cover piece 86 and the double-sided adhesive piece 88 is attached to the resinous layer 124, after the required matter is printed on the printing paper strip 1*a* by the electric discharge printing method. When thus obtained baggage tag 1*b* is fitted to the baggage of the present passenger, the cover piece 86 is stripped off from the double-sided adhesive piece 88, and the printing paper strip 1*a* is folded in the manner shown in FIG. 14. The end of the printing paper strip 1*a* is attached to the exposed adhesive surface of the double-sided adhesive piece 88.

The conventional printing paper strip for the baggage tag consists only of the lining paper sheet 121, the printing paper sheet 122 and the aluminum layer 123, and the adhesive member 62*a* is attached directly to the lining paper sheet 121. The adhesive member firmly adheres to the lining paper sheet 121. Accordingly, when some peeling force is imparted to the adhesive member 62*a*, the lining paper sheet 121 is liable to be torn with the adhesive member 62*a*. However, with the printing paper strip 1*a*, since the adhesive member 62*a* is attached to the resinous layer 124, the lining paper sheet 122 resists tearing with the adhesive member 62*a*, even when some peeling force is imparted to the adhesive member 62*a*. The cover piece 86 can be smoothly peeled from the double-sided piece 88 without tearing the paper strip 1*a*. That is convenient for the handling of the baggage provided with the baggage tag 1*b*.

Next, an electric discharge printing apparatus employed for this embodiment will be described with reference to FIG. 15 and FIG. 16.

FIG. 15 is a schematic view of the electric discharge printing apparatus. In FIG. 15, a pattern of character generator 141 comprises a read-only memory. Characters required for the baggage tag or boarding pass, such as alphabets and figures (numerals), are memorized in the pattern generator 141. FIG. 16 shows a part of the memory content of the pattern generator 141. With the readout of this part a letter "J" is printed on a printing paper strip 144 which may be structured as shown in FIG. 12 or FIG. 13 for the boarding pass or baggage tag.

A control circuit 142 is connected to the pattern generator 141. Required characters are read out from the pattern generator 141 with address signals obtained from the control circuit 142. A buffer register 143 is connected to the output terminals of the pattern generator 141. A duration of a pulse-like signal from the pattern generator 141 is prolonged by the buffer register 143. Amplifiers $A_1$, $A_2$ - - - Am for vertical lines $lb_1$, $lb_2$ - - - $lbm$ of the memory plane (FIG. 16) are connected to the buffer register 143. Electric discharge stylus electrodes $P_1$, $P_2$ - - - Pm for the vertical lines $lb_1$, $lb_2$ - - - $lbm$ are arranged at intervals of a small distance, facing the printing paper strip 144. Output signals from the buffer register 143 are supplied through the amplifiers $A_1$, $A_2$ - - - Am to the electric discharge stylus electrodes $P_1$, $P_2$ - - - Pm.

The uppermost layer of the printing paper strip 144 is a conductive metallic layer, for example, aluminum layer. The printing paper strip 144 is transported at a predetermined speed by a feed roller 145 in the direction shown by Y. A grounding roller 146 contacts the printing paper strip 144, and is rotatably supported by a not-shown support. The printing paper strip 144 is electrically connected to the ground, through the grounding roller 146 which is connected to the ground by a brush.

Next, operation of the above described electric discharge printing apparatus will be described.

For example, there will be described the case of the letter "J" being printed on the printing paper strip 144. The address of the letter "J" is selected from the memory contents of the pattern generator 141 with the control signal of the control circuit 142. With reference to FIG. 16, the signals of the intersections (elements) of a first horizontal line $1a_1$ and vertical lines $1b_1$, $1b_2$ - - - $1bm$ are supplied through the buffer register 143 and the amplifiers $A_1$, $A_2$ - - - Am to the electric discharge stylus electrodes $P_1$, $P_2$ - - - Pm, respectively. In FIG. 16, signals "1" are memorized in hatched intersections, while signals "0" are memorized in blank intersections. Accordingly, an electric discharge voltage is supplied to none of the electric discharge stylus electrodes $P_1$, $P_2$ - - - Pm, when the output signals are obtained from the intersections of the horizontal line $1a$ and vertical lines $1b_1$, $1b_2$ - - - $1bm$. Next, a line control instruction is supplied to the pattern generator 141 to transmit the signals of the intersections of a second horizontal line $1a_2$ and the vertical lines $1b_1$, $1b_2$ - - - $1bm$ to the buffer register 143. As understood from FIG. 16, signals "1" are memorized in the intersections ($1a_2$ and $1bp$ to $1bq$). Accordingly, the discharge voltage is supplied to some of the electric discharge stylus electrodes $P_1$ to Pm which correspond to the intersections ($1a_2$ and $1bp$ to $1bq$). Portions of the surface of the printing paper strip 144, directly facing the energized ones of the electric discharge stylus electrodes $P_1$ to Pm, are electrically and dottedly broken to form a part of the letter "J". Supply of the discharge voltage to the electric discharge stylus electrodes $P_1$, $P_2$ - - - Pm is controlled in the above described manner. Thus, the letter "J" is printed on the printing paper strip 144. In succession, a next character such as a letter or letters, or a figure or figures is similarly selected from the pattern generator 141 with the control signals of the control circuit 142, to be printed on the printing paper strip 144 which continuously runs in a direction shown by Y.

The printing speed of the electric discharge printing apparatus is very high. Accordingly, the electric discharge printing apparatus is very convenient for the printing-out system of the airlines in which both a boarding pass and a baggage tag should be concurrently printed out for one passenger.

The direction of the character or figure to be printed on the printing paper strip can be easily changed simply with the modification of the arrangement of the pattern memorized in the pattern generator 141. Although the character is dottedly printed on the printing paper by the electric discharge, it is formed in lines as shown by JAL in FIG. 11, since the dots are conjoined with each other.

Figure 17:
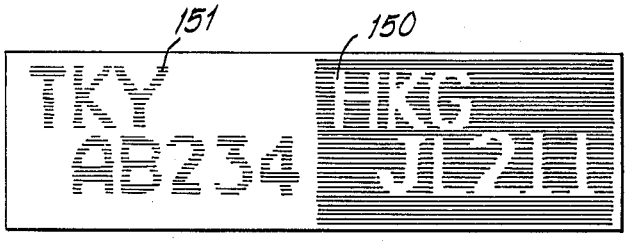
FIG. 17 is a plan view of a part of an interline baggage tag obtained by the printing system.

Generally, it is required to distinguish between a domestic line baggage tag and an interline baggage tag. The interline baggage tag is used for a passenger's baggage which shall be transferred from one airline to another airline. For example, it is possible to distinguish between them by coloring. However, the color printing apparatus is very expensive. It is therefore desirable to distinguish between them in an inexpensive manner. In this embodiment, a printing method illustrated in FIG. 17 is employed for the distinction of the domestic line baggage tag and interline baggage tag. FIG. 17 shows a part of an interline baggage tag. Characters are printed on the printing paper strip as above described, by the above electric discharge printing apparatus. A destination TKY and a flight number AB234 are positively printed on one part 151 of the printing paper strip, while another destination HKG and another flight number JL211 are negatively printed on another part 150 of the printing paper strip. For example, when the letter "J" is negatively printed on the printing paper strip, referring to FIG. 16, the signals "1" are memorized in the blank intersections of the horizontal lines $1a_1$, $1a_2$ - - - $1an$ and vertical lines $1b_1$, $1b_2$ - - - $1bm$ of the memory plane, while the signals "0" are memorized in the hatched intersections of the horizontal lines $1a_1$, $1a_2$ - - - $1an$ and vertical lines $1b_1$, $1b_2$ - - - $1bm$ of the memory plane.

In the manner shown in FIG. 17, the domestic line baggage tag and the interline baggage tag can be easily distinguished from each other. The electric discharge printing method is more inexpensive than the color printing method. The thermal printing method or any other printing method may be employed for the negative-positive printing of FIG. 17.

A worker handling a passenger's baggage provided with a baggage tag should be able to read letters to recognize the destination of the passenger from the baggage tag attached to the passenger's baggage. However, there are some unlettered workers in the baggage handling sections of the aviation companies of some underdeveloped countries. At present, indications of destinations are classified by coloring, for them. However, there are some problems in the coloring classification. For example, the color of the indication of the destination appears changed under a mercury-vapor lamp. If the worker is color-blind, he cannot recognize the destination. At present, the indications of the destinations are classified into about fifty kinds of coloring. However, the number of kinds of colors is limited. Moreover, color printing is expensive.

Figure 18:
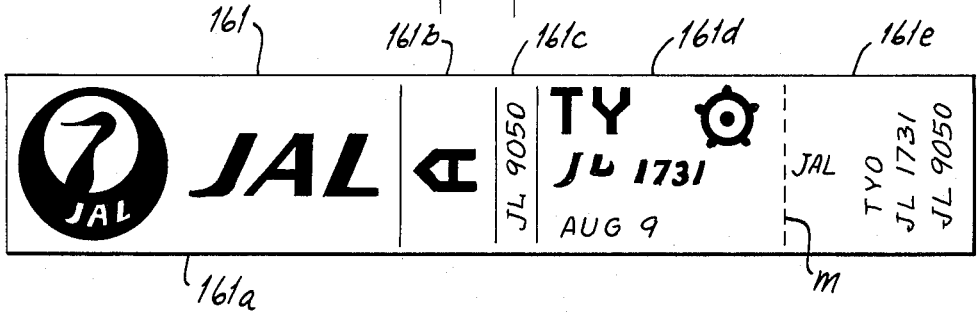
FIG. 18 is a plan view of a baggage tag obtained by the printing system.
Figure 19:
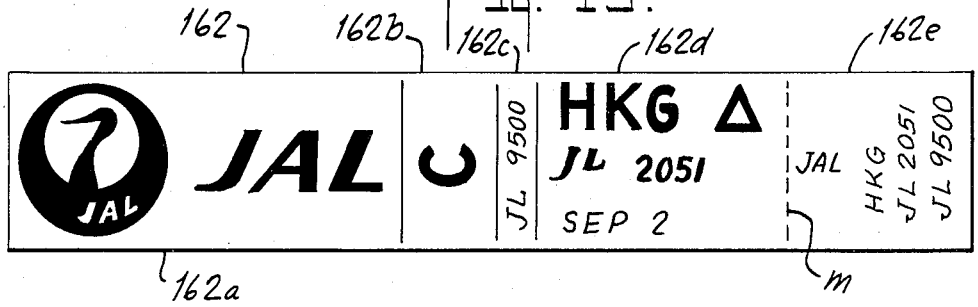
FIG. 19 is a plan view of another baggage tag obtained by the printing system.

In order to overcome the above-described disadvantages of the conventional baggage tag, a baggage tag is printed out in the manner shown in FIG. 18 and FIG. 19, according to the printing system of this embodiment.

FIG. 18 and FIG. 19 show two examples 161 and 162 of baggage tags according to this embodiment. In FIG. 18 and FIG. 19, first parts 161*a* and 162*a* indicate the name of the aviation company. Second parts 161*b* and 162*b* indicate the sorts of airlines. Third parts 161*c* and 162*c* indicate issue numbers of the baggage tags 161 and 162. Fourth parts 161*d* and 162*d* indicate destinations, flight numbers (JL1731 and JL 2051), and boarding dates. Fifth parts 161*e* and 162*e* are available for baggage identification stubs. The fifth parts 161*e* and 162*e* are separated at the perforations m from the remaining parts 161*a* to 161*d* and 162*a* to 162*d* of the baggage tags 161 and 162, as the stubs.

According to this embodiment, a figure ⊙ is printed at the side of the destination TYO (Tokyo) in the fourth part 161*d* of the baggage tag 161. The figure ⊙ represents Tokyo. Another figure Δ is printed at the side of the destination HKG (Hong Kong) in the fourth part 162*d* of the baggage tag 162. The figure Δ represents Hong Kong.

FIG. 18 shows the baggage tag for a passenger who boards an airplane of flight number JL 1731, A-line for Tokyo on the ninth of August. FIG. 19 shows the baggage tag for a passenger who boards an airplane on flight number JL 2051, C-line for Hong Kong on the second of September. Even an unlettered worker can recognize the destination of the baggage as Tokyo or Hong Kong from the baggage tag of FIG. 18 or FIG. 19, if he knows that the figure ⊙ or Δ represents Tokyo or Hong Kong. The baggage tag of FIG. 18 or FIG. 19 can be printed out by the electric discharge printing apparatus shown in FIG. 15. In such a case, the figures ⊙ and Δ are memorized in the pattern generator 141. Of course, figures for any other destinations are similarly memorized in the pattern generator 141. Any other printing method such as thermal printing method may be employed for printing out the baggage tag of FIG. 18 or FIG. 19. It will be recommended that the correspondence of the countries with the figures is standardized by the International Air Transport Association (IATA).

The destinations are memorized in the pattern generator, associated with the corresponding figures. When one of the destinations, such as TYO, is read out from the pattern generator with the operation of the key board of the operating unit E, the destination and the corresponding figure are concurrently printed on the printing paper strip. The operator does not always need to memorize the correspondence of the destinations with the figures.

Figure 20:
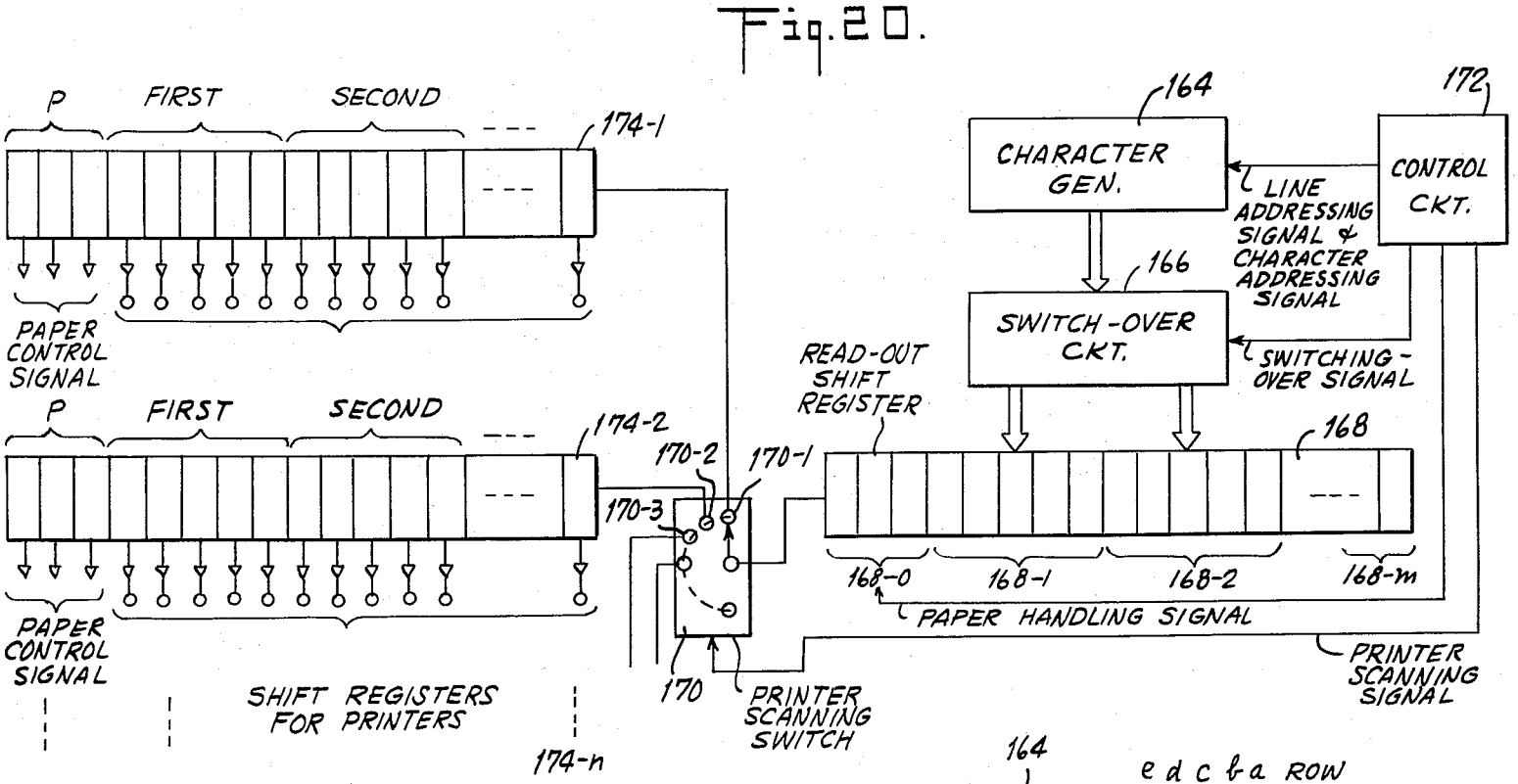
FIG. 20 is a block diagram of a control system employed for the printing system.
Figure 21:
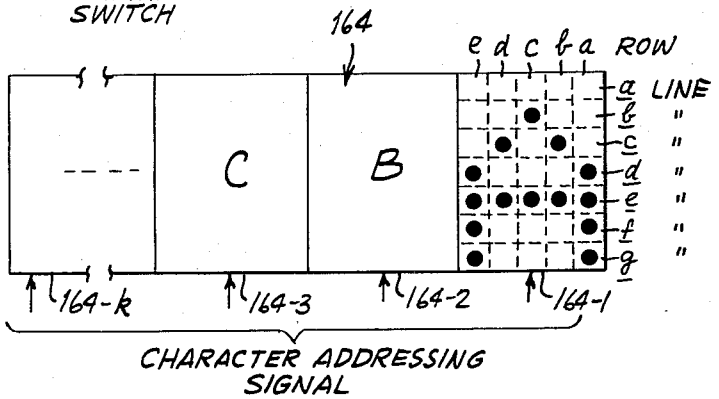
FIG. 21 is a plan view of a part of a character generator in the control system in FIG. 20.

Next, there will be described a control system which is suitable for the printer of the printing system according to this embodiment. FIG. 20 and FIG. 21 show the control system.

Referring to FIG. 20, the control system comprises a character generator 164, a switching-over circuit 166, a read-out shift register 168, a printer scanning switch 170, a control circuit 172, and shift registers 174-1, 174-2 - - - **174-*n* for respective printers. For example, the two 174-1 and 174-2 of the shift registers 174-1, 174-2 - - - 174-*n* are used for the boarding pass printer and baggage tag printer, respectively. The control system shown in FIG. 20 is generally used for plural printers and uses a time sharing technique implemented by scanning switch 170**.

The character generator 164 includes plural memory matrixes 164-1, 164-2 - - - **164-*k* as shown in FIG. 21. One character such as A, B or C is memorized in each of the memory matrixes 164-1, 164-2 - - - 164-*k*. For example, signals "1" shown by dots in FIG. 21 are memorized in intersections (elements) of b-line and c-row, c-line and b-row, c-line and d-row, and so on, of the first memory matrix 164-1** so as to form the dotted letter "A". Thus, signals "1" are memorized in the dotted elements, while signals "0" are memorized in the blank elements. In a similar manner, the letters B, C - - - are memorized in the second, third - - - *k*-th memory matrixes 164-2, 164-3 - - - **164-*k***, respectively.

A character addressing signal and line addressing signal are supplied to the character generator 164 from the control circuit 172. The output of the character generator 164 is supplied to the switching-over circuit 166 which is controlled with a switching-over signal supplied from the control circuit 172. The output of the switching-over circuit 166 is supplied to the read-out shift register 168. The read-out shift register 168 consists of plural memory parts 168-0, 168-1, 168-2 - - - 168-m. Signals for handling the printing paper strip are supplied to the memory part 168-0 of the read-out shift register 168 from the control circuit 172. The signals are, for example, for starting, stopping and cutting the printing paper strip.

Signals for characters to be printed out are temporarily memorized in the memory parts 168-1, 168-2 - - - 168-m of the read-out shift register 168, in the printing order of the characters. The read-out shift register 168 is changed over from one memory part to the next memory part to be input with the switching-over circuit 166.

When "ABC" is to be printed on the printing paper strip, the letters A, C and B are selected from the character generator 164 with the character addressing signal of the control circuit 172. First, the memory contents of the first line (corresponding to the a-line) of the memory matrix 164-1 are supplied to the first memory part 168-1 of the read-out shift register 168. In this example, the respective memory parts 168-1, 168-2 - - - 168-m consist of five bits corresponding to the number of the rows of the respective memory matrixes 164-1, 164-2 - - - 164-k. As apparent from FIG. 21, the signals "0, 0, 0, 0, 0" are memorized in the memory part 168-1 of the read-out shift register 168. Then, the read-out shift register 168 is changed from the first memory part 168-1 to the second memory part 168-2 to be input with the switching-over circuit 166 to which the switching signal is supplied from the control circuit 172. In a similar manner, the memory contents of the first line of the memory matrix 164-3 are supplied to the second memory part 168-2 of the read-out shift register 168. Then, the read-out shift register 168 is changed from the second memory part 168-2 to the third memory part 168-3 to be input with the switching-over circuit 166 to which the switching signal is supplied from the control circuit 172. The memory contents of the first line of the memory matrix 164-2 are supplied to the third memory part 168-3 of the read-out shift register 168. In such manner, the read-out shift register 168 is changed over from one memory part to the next memory part to be input with the switching-over circuit 166. In this example, the signals "0" are memorized in the fourth memory part 168-4, the fifth memory part 168-5, - - - and the m-th memory part 168-m.

When the letters ACB are printed on the printing paper for the boarding pass in the boarding pass printer, the signals in the read-out shift register 168 are transmitted to the shift register 174-1 through the printer scanning switch 170 which is changed over to a first contact 170-1 with a printer scanning signal supplied from the control circuit 172. The read-out shift registers 174-1, 174-2 - - - 174-3 - - - 174-n consist of plural memory parts, corresponding to the first-mentioned read-out shift register 168, respectively. The paper control memory part P, first memory part, second memory part, - - - and m-th memory part, of the read-out shift registers 174-1, 174-2 - - - 174-n, each correspond to the memory parts 168-0, 168-1, 168-2 - - - 168-m of the first-mentioned read-out memory 168.

The boarding pass printer is controlled with the signals of the read-out shift register 174-1. The printing-out speed of the printer is much lower than the read-out speed of the shift registers. Accordingly, a time-sharing technique is employed for this control system. During the printing operation of the boarding pass printer, the printer scanning switch 170 is changed from the first contact 170-1 to a second contact 170-2 with the printer scanning signal, and the memory contents of the first read-out shift register 168 are transmitted to the printer read-out shift register 174-2 for the baggage tag. In that case, characters different from the letters ACB may be printed on the printing paper for the baggage tag, when the memorized signals are changed in the shift register 168 with the control circuit 172 and switching-over circuit 166. Of course, the letters ACB may be printed on the printing paper in the baggage tag printer.

The printer scanning switch 170 is changed over, in turn, from one contact to the next contact, with the printer scanning signal supplied from the control circuit 172. Then, the memory contents of the second line (corresponding to the b-line in FIG. 21) of the memory matrixes 164-1, 164-3 and 164-2 of the character generator 164 are supplied to the read-out shift register 168, in the same manner as the memory contents of the first line of the memory matrixes 164-1, 164-3 and 164-2, when the printing scanning switch 170 is again changed over to the first contact 170-1. The memory contents of the first shift register 168 are transmitted to the shift register 174-1 for the boarding pass printer.

In the above-described manner, the memory contents of the memory matrixes 164-1, 164-3 and 164-2 are transmitted to the read-out shift register 174-1, while the memory contents of the different or same memory matrixes are transmitted to the read-out shift register 174-2 for the baggage tag printer, and the remaining read-out shift registers 174-3, 174-4 - - - and **174-*n*. Thus, the letters "ACB" are printed on the printing paper for the boarding pass. For example, the electric discharge printing apparatus shown in FIG. 15 may be electrically connected to the read-out shift registers 174-1 and 174-2 of the control system of FIG. 20**.

According to the above-described control system, the printers 32 and 132 of FIG. 3 and FIG. 6 are concurrently operated in a time-sharing way. The boarding pass and baggage tag can be very efficiently issued from the printing system.

While there has been described a preferred embodiment of this invention, obviously further modifications and variations are possible in light of the above teachings. It is therefore to be understood that within the scope of the appended claims, the invention may be practised otherwise than as specifically described.

It may be used for passengers on all forms of transportation, as well as airlines, and may be found suitable for many other group processing activities wherein a series of items are tagged or identified in a manner analogous to passenger processing.

I claim:

1. A printing system for a boarding pass and/or baggage tag comprising:

control means for providing instructions for printing passenger-related information;

a housing;

a printing unit contained in said housing and controlled with said control means comprising:

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

and wherein said control means comprises pattern generator means for memorizing passenger-related characters; and said dotting printer means comprises a thermal printing apparatus which comprises a plurality of thermal elements arranged in a line opposite the top surface of said printing paper strip and controlled by output signals from said pattern generator means.

2. A printing system for a boarding pass and/or a baggage tag comprising:

control means for providing instructions for printing passenger-related information;

a housing;

a printing unit contained in said housing and controlled with said control means comprising:

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

a roll of an adhesive tape in said housing, said adhesive tape comprising:

a tape base;

a plurality of double-sided adhesive pieces attached on one side to said tape base at regular intervals along said tape base; and a plurality of cover pieces each substantially equal in size to said adhesive pieces and respectively attached to the opposite sides of said adhesive pieces from said tape base to form a plurality of adhesive members regularly spaced on said tape base;

stripping means for stripping said adhesive members from said tape base;

take-up means for taking up said tape after said adhesive members are stripped therefrom; and means for respectively attaching said stripped adhesive members to the backs of said printed and cut printing paper strips.

3. A printing system as in claim 2 further comprising cassette means for rotatably supporting said roll of adhesive tape therein and means in said housing for accommodating said adhesive tape cassette means therein.

4. A printing system as in claim 3 wherein said adhesive tape cassette means comprises a casing containing said stripping means and said take-up means.

5. A printing system as in claim 2 further comprising means for synchronously driving said take-up means and said ejecting means.

6. A printing system as in claim 5 wherein said drive means comprises:

a drive gear;

an idle gear;

a first disc fixedly disposed concentrically with said drive gear and having a diameter substantially equal to the pitch diameter of said drive gear;

a second disc fixedly disposed concentrically with said idle gear and having a diameter substantially equal to the pitch diameter of said idle gear; and spring means for urging said first and second discs into engagement with each other whereby the engagement of the circumferential surfaces of said discs maintains the backlash between said drive gear and said idle gear in a predetermined condition.

7. A printing system as in claim 6 wherein said take-up means further comprises:

a take-up reel; and a sprocket wheel rotated with said idle gear for feeding said tape to said take-up reel.

8. A printing system as in claim 5 wherein said stripping means comprises:

means cooperating with said take-up means for extremely bending said tape base to separate said adhesive members therefrom; and means for guiding said adhesive members toward said attaching means.

9. A printing system as in claim 8 wherein said attaching means comprises:

first roller means in said ejecting means for engaging the printed side of said printed and cut printing paper strip while said strip is advanced therethrough;

a pivoted lever having two free ends;

a plunger-solenoid connected to one of said lever ends; and second roller means on the other end of said lever for receiving said stripped adhesive members thereon and pivotable upon the energizing of said plunger-solenoid to carry said stripped adhesive members to the back of said printed and cut printing paper strip so as to press said paper strip and said adhesive member between said first and second roller means with the adhesive side opposite said cover piece engaging the back of said paper strip whereby said adhesive member is attached to said paper strip.

10. A printing system as in claim 2 wherein said printing paper strip comprises a resinous layer matted on the back thereof to which said adhesive members are attached.

11. A printing system as in claim 10 wherein said printing paper strip further comprises a layer of aluminum deposited on the front thereof.

12. A printing system for a boarding pass and/or a baggage tag comprising:

control means for providing instructions for printing passenger-related information;

a housing;

a printing unit contained in said housing and controlled with said control means comprising;

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

and wherein said dotting printer means comprises means for printing said characters both positively and negatively on said printing paper strip.

13. A printing system for a boarding pass and/or a baggage tag comprising:

control means for providing instructions for printing passenger-related information;

a housing;

a printing unit contained in said housing and controlled with said control means comprising;

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing; and cassette means for rotatably supporting said roll of printing paper strip therein and means for mounting said cassette means in said housing.

14. A printing system as in claim 13 wherein said cassette means comprises:

a casing;

outlet means in said casing for passing said paper strip therethrough; and guide roller means in said casing for guiding said paper strip to said outlet means.

15. A printing system as in claim 14 wherein said cassette means further comprises grip means fixed to said casing for facilitating the manipulation thereof.

16. A printing system for a boarding pass and/or a baggage tag comprising:

control means for providing instructions for printing passenger-related information;

a housing;

a printing unit contained in said housing and controlled with said control means comprising:

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

and wherein said cutting means comprises means for perforating said printed paper strip and said ejecting means comprises means for advancing said printed and perforated paper strip before cutting.

17. A printing system for a boarding pass and/or a baggage tag comprising:

control means for providing instructions for printing passenger-related information;

a housing; and first and second printing units contained in said housing and controlled substantially simultaneously in a time-sharing way with said control means in common comprising:

first and second rolls of printing paper strips;

first and second feeding means for drawing out said printing papers from said rolls and advancing them within said housing;

first and second guide means for guiding said advancing printing paper strips;

first and second dotting printer means for printing passenger-related characters on said advancing printing paper strips in accordance with said instructions from said control means;

first and second cutting means for cutting and advancing printing paper strips after being printed; and first and second ejecting means for ejecting said printed and cut printing paper strips from said housing.

18. A printing system for a board pass and/or a baggage tag according to claim 17 in which said first printing unit is used for boarding passes and said second printing unit is used for baggage tags.

19. A printing system as in claim 1 for a boarding pass and/or a baggage tag comprising:

control means for providing instructions for printing passenger-related information;

a housing;

a printing unit contained in said housing and controlled with said control means comprising;

a roll of printing paper strip;

feeding means for drawing out said printing paper strip from said roll and advancing it within said housing;

guide means for guiding said advancing printing paper strip;

dotted printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

and wherein said printing paper strip comprises:

a printing paper layer;

a lining paper layer;

a flexible film interposed between and attached to said printing paper layer and said lining paper layer; and a layer of aluminum deposited on said printing paper layer.

20. A printing system as in claim 1 for a boarding pass and/or a baggage tag comprising:

control means for providing instructions for printing passenger-related information;

a housing;

a printing unit contained in said housing and controlled with said control means comprising:

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

and wherein said control means comprises pattern generator means for memorizing passenger-related characters; and said dotting printer means comprises an electric discharge printing apparatus which comprises a plurality of discharge electrodes arranged in a line opposite the top surface of said printing paper strip and controlled by output signals from said pattern generator means.

21. A printing system for a boarding pass and/or a baggage tag comprising:

control means for providing instructions for printing passenger-related information;

a housing;

a printing unit contained in said housing and controlled with said control means comprising;

a roll of printing paper strip;

feeding means for drawing out said printing paper strip from said roll and advancing it within said housing;

guide means for guiding said advancing printing paper strip;

dotting printer means for printing passenger-related characters on said advancing printing paper strip in accordance with said instructions from said control means;

cutting means for cutting said advancing printing paper strip after being printed; and ejecting means for ejecting said printed and cut printing paper strip from said housing;

and wherein said control means comprises:

a character generator having a plurality of memory matrices consisting of memory elements;

a first shift register having a plurality of memory parts for readout;

switching-over circuit means connected between said character generator and said first-shift register for changing over said memory parts from one to another to supply the memory content of the corresponding one of said matrices;

a plurality of second shift registers;

a printer scanning-switch means for selectively transmitting the memory contents of said first shift register in a time sharing manner to respective second shift registers and thus to said dotting printer means; and control circuit means for supplying a line-addressing signal and a character-addressing signal to said character generator, a switching-over signal to said switching-over circuit means and a printer scanning signal to said printer scanning-switch means to control and scan the output of said dotting printer means.

22. A printing system as in claim 21 wherein said first shift register comprises means for memorizing printing paper strip handling signals in one of said memory parts.

23. A printing system as in claim 22 wherein said dotting printer means comprises a plurality of discharge electrodes arranged in a line opposite said printing paper strip and said second shift registers are respectively connected to said discharge electrodes.

* * * * *